US006966312B1

(12) United States Patent
Larson

(10) Patent No.: US 6,966,312 B1
(45) Date of Patent: Nov. 22, 2005

(54) SINGLE-CAM COMPOUND BOW WITH MULTIPLE IDLER WHEELS

(76) Inventor: Marlow W. Larson, 2735 S. 4050 W., Ogden, UT (US) 84401

( * ) Notice: Subject to any disclaimer, the term of this patent is extended or adjusted under 35 U.S.C. 154(b) by 0 days.

(21) Appl. No.: 10/806,585

(22) Filed: Mar. 23, 2004

Related U.S. Application Data

(60) Provisional application No. 60/458,207, filed on Mar. 27, 2003.

(51) Int. Cl.[7] ..... F41B 5/10
(52) U.S. Cl. ..... 124/25.6; 124/900
(58) Field of Search ..... 124/25.6, 900

(56) References Cited

U.S. PATENT DOCUMENTS 4,061,124 A * 12/1977 Groner ..... 124/25.6
4,064,862 A * 12/1977 Groner ..... 124/25.6
4,077,385 A * 3/1978 Fredrickson ..... 124/25.6
4,103,667 A * 8/1978 Shepley, Jr. ..... 124/25.6
4,187,826 A * 2/1980 Killian ..... 124/25.6
4,722,317 A * 2/1988 Hartwig ..... 124/25.6
5,687,703 A * 11/1997 Vyprachticky ..... 124/25.6
5,890,480 A * 4/1999 McPherson ..... 124/25.6
5,950,609 A * 9/1999 Thielen et al. ..... 124/25.6
6,076,512 A * 6/2000 Thielen et al. ..... 124/25.6

* cited by examiner

*Primary Examiner*—John A. Ricci
(74) *Attorney, Agent, or Firm*—Brian C Trask

(57) ABSTRACT

An archery compound bow having first and second opposed limbs. The bowstring rigging typically includes a power cam associated with the first limb, and a pair of idler wheels associated with the second limb. Drawing the bow by retracting the drawstring to rotate the power cam causes the idler wheels to rotate at different rates of angular displacement. The bowstring rigging can be arranged to rotate the idler wheels in either the same direction, or in different directions.

26 Claims, 6 Drawing Sheets

SINGLE-CAM COMPOUND BOW WITH MULTIPLE IDLER WHEELS

RELATED APPLICATIONS

This application claims the benefit under 35 U.S.C. 119(e) of the filing date of Provisional Application Ser. No. 60/458,207, filed Mar. 27, 2003 and titled "COMPOUND ARCHERY BOW".

BACKGROUND

1. Field of the Invention

This invention pertains to compound archery bows of the type commonly known as "single-cam" bows. It provides a novel rigging for such bows characterized by multiple "idler" wheels.

2. State of the Art

Single-cam compound bows are disclosed by U.S. Pat. Nos. 5,368,006 and 5,505,185, the disclosures of which are incorporated as a part of this specification for their teachings concerning alternative structural arrangements and the operation of such bows. Compound bow rigging arrangements, and the terminology applied to such arrangements are disclosed by U.S. Pat. No. 5,495,843, the disclosure of which is incorporated as a portion of this specification.

BRIEF SUMMARY

Bow terminology has not been rigorously consistent over the years. Accordingly, for purposes of this disclosure, and the appended claims, the bow is considered in its normal use position to have an upper limb (extending skyward) and a lower limb (extending towards the ground). The archer is considered to be positioned to the rear of the bow, with the back of the bow nearest the archer and the front of the bow nearest the target. Pivoting elements (cams, pulleys and/or wheels) referred to in this disclosure should be understood to include tracks to guide the take-up or payout of stretches (of cables or strings) as those pivoting elements are induced to rotate by either pulling or releasing the bowstring portion of the bow's rigging. Those tracks are usually configured as grooves (or functionally equivalent guide structures) on the working surfaces of the pivoting elements. "Working surfaces" refers to the surface portions of the elements upon which rigging is either wound onto, or unwound from, during the drawing or release of the bow string.

This invention provides a novel rigging for single-cam compound archery bows. Unlike other arrangements, the rigging of this invention includes multiple (typically two) idler wheels. Bows of this invention typically include a central handle riser with upper and lower ends (as viewed in its normal use orientation). The bow further includes upper and lower limbs. Each such limb has a proximal end connected to the corresponding end of the handle riser and a distal end. A "single-cam" component (sometimes called a "power cam") is mounted to one of these limbs, usually at or near its distal end. Multiple idler wheels are mounted to the other limb, again typically at or near its distal end. These idler wheels are usually simple wheels (pulleys) mounted to rotate on a common central axis. They may be circular or non circular, and they may be eccentrically mounted. They will usually, but not necessarily, have identical profiles, but the cable tracks of respective idler wheels may be configured independently. The wheels are usually, but need not necessarily be, mounted on a common axle.

A notable characteristic of the multiple idler wheels of the rigging of this invention is that they are independently mounted. They are permitted to rotate in different directions and/or at different rates of angular displacement. These degrees of freedom enable the bow designer to fine tune the force draw characteristics of various embodiments.

The single-cam component of the rigging may be of any operable configuration. That is, the timing or profile configurations of the various guide tracks carried by this component, while significant to the resulting force draw characteristics of the bow, are inevitably compatible with the multiple idler wheels of the rigging.

The invention may be viewed broadly as including various embodiments of an archery bow, comprising a handle with first and second ends. A first limb (which may, but need not, be the lower limb) has a proximal end connected to the first end of the handle and a distal end. A second limb (which may, but need not, be the upper limb) has a proximal end connected to the second end of the handle and a distal end. A cam element is operably associated with one of the limbs (most often, the lower limb). A pair of idler wheels, including a first idler wheel and a second idler wheel, is operably associated with the other limb. A bowstring element is operably associated with the cam element and the first and second idler wheels such that when the string is pulled to pivot the cam element, the idler wheels are caused to pivot at different rates of angular displacement. For reasons of simplicity of manufacture, the first and second idler wheels may conveniently be provided with substantially similar configurations. Similarly, the first and second idler wheels usually carry guide tracks of substantially similar configuration (taking into account their respective directions of rotation)

BRIEF DESCRIPTION OF THE DRAWINGS

In the drawings, which illustrate what is currently considered to be the best mode for carrying out the invention.

DETAILED DESCRIPTION OF THE ILLUSTRATED EMBODIMENT

Figure 1:
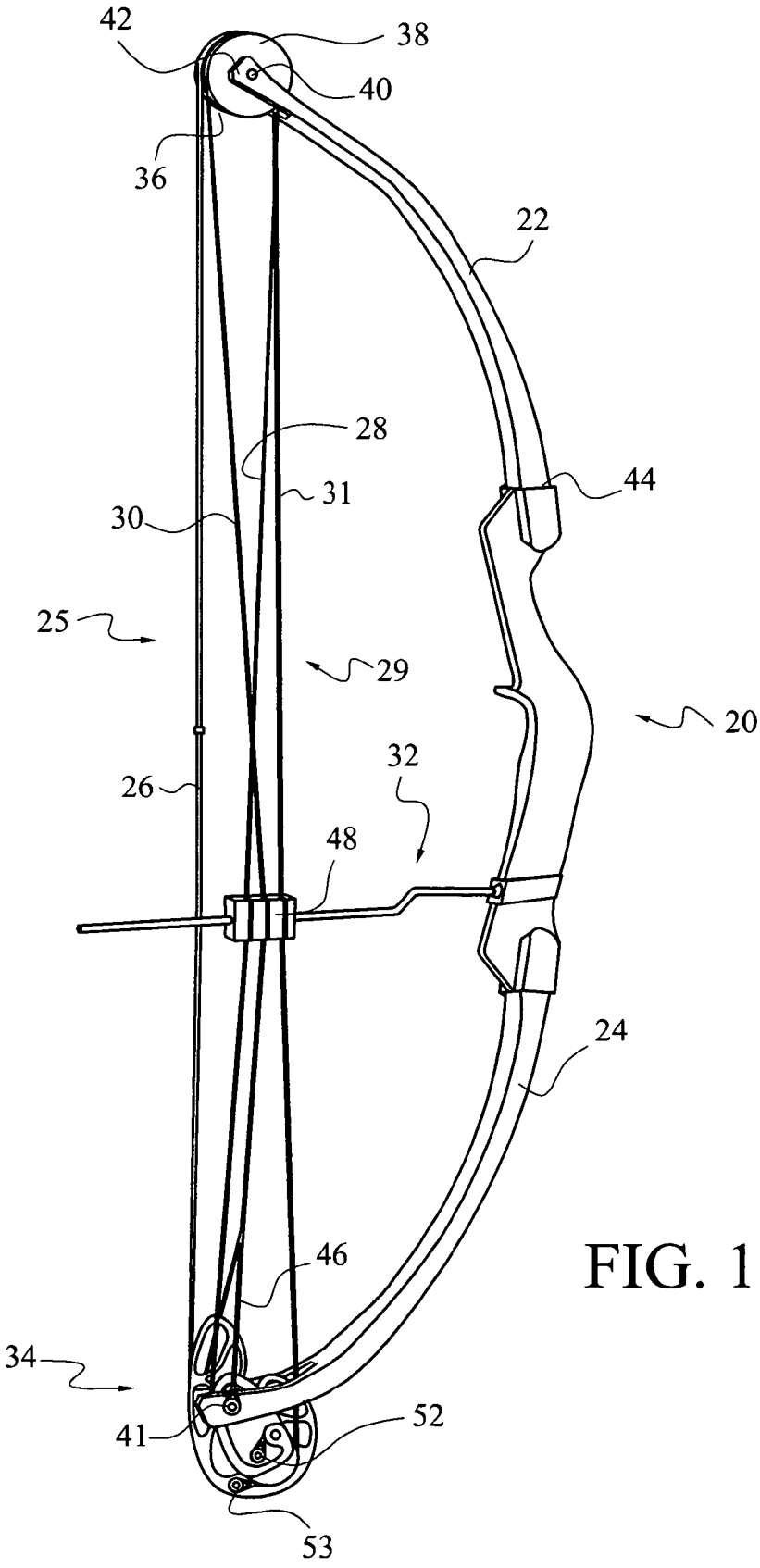
FIG. 1 is a view in perspective from behind of a typical compound archery bow embodying the invention.
Figure 2:
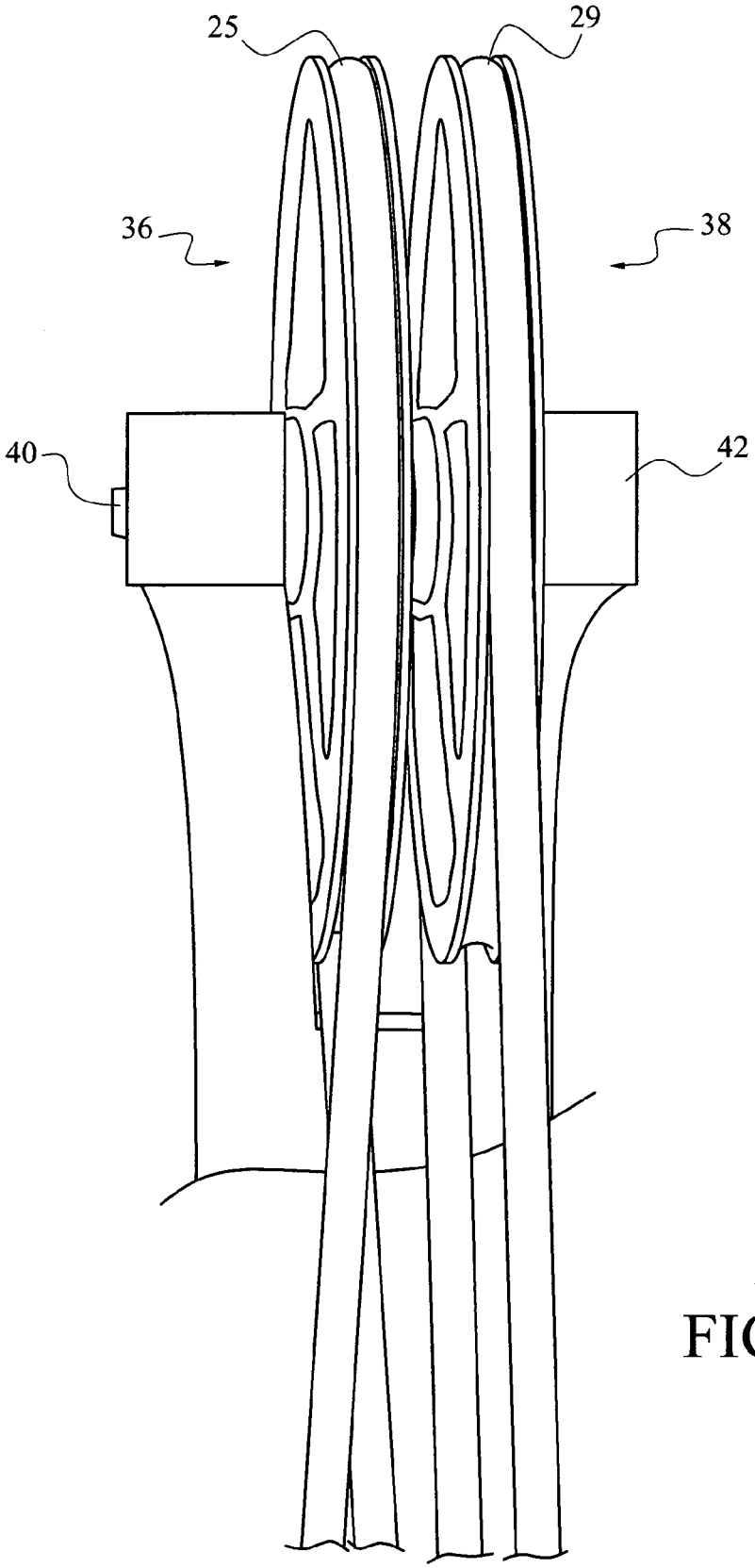
FIG. 2 is a back view in perspective of the upper limb tip portion of the bow of FIG. 1, as viewed from a normal use position.
Figure 3:
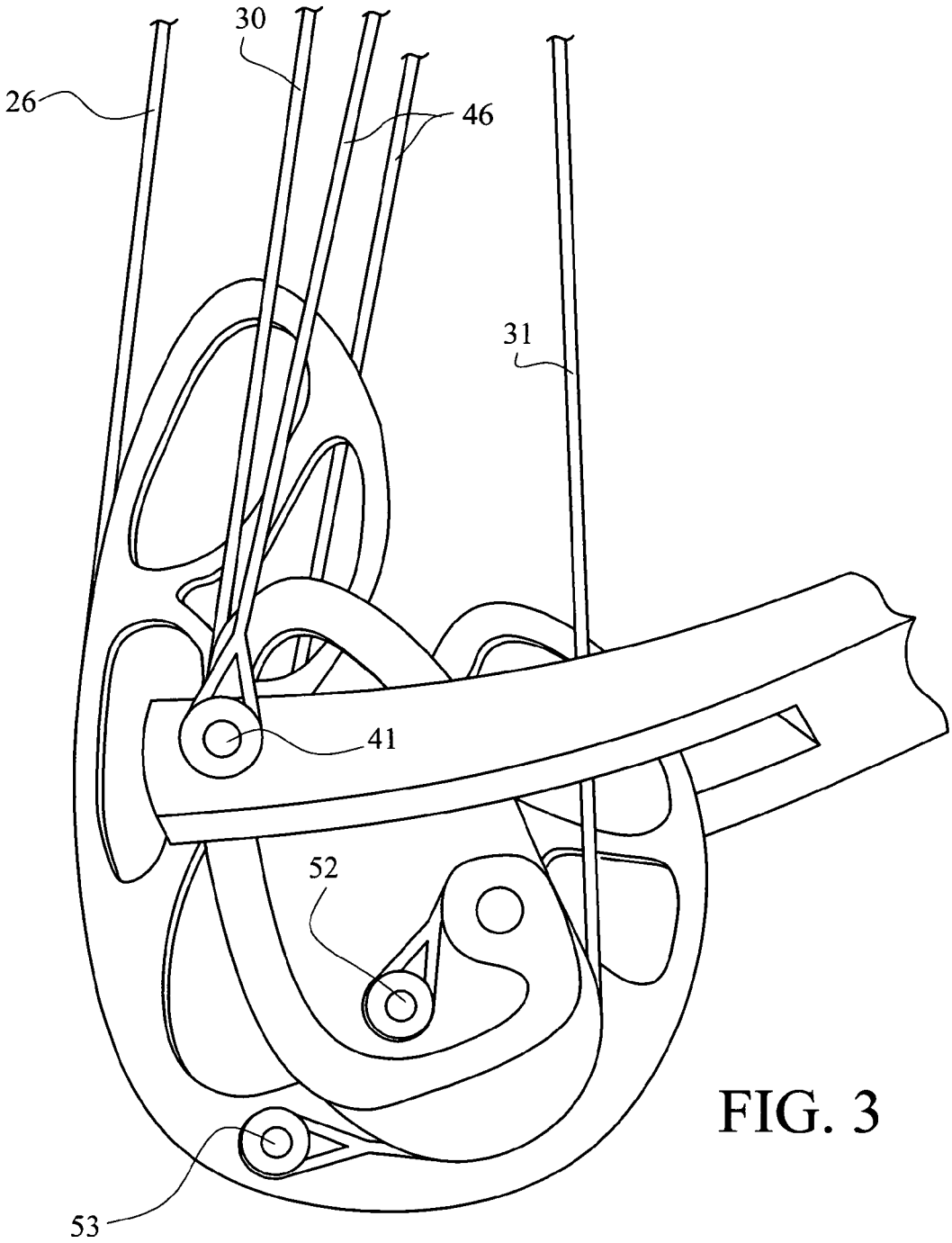
FIG. 3 is a side view in perspective of the lower limb portion of the bow of FIG. 1; showing a typical power cam component.
Figure 4:
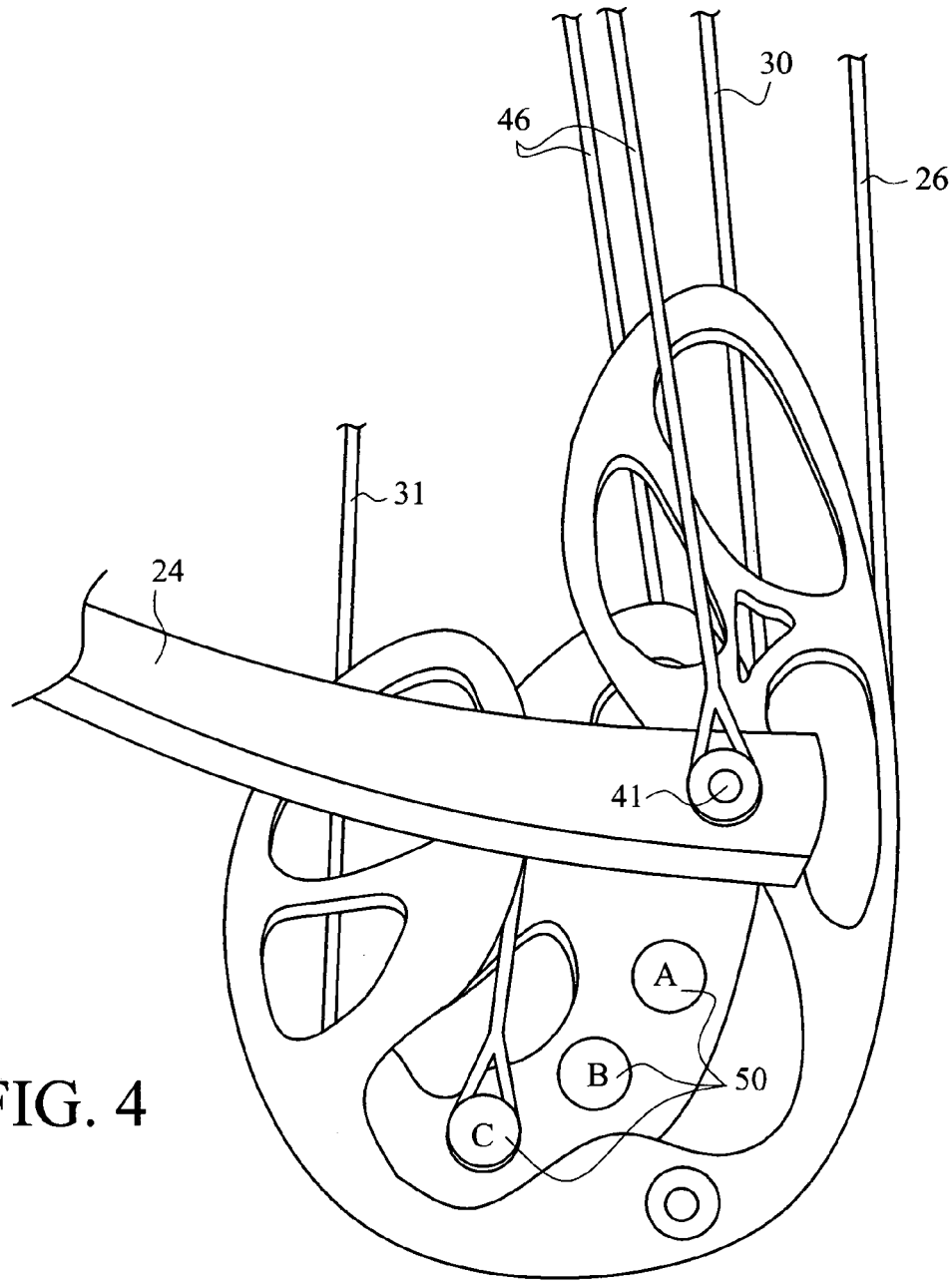
FIG. 4 is a view similar to FIG. 3, showing the opposite side of the power cam and lower limb portion.
Figure 5:
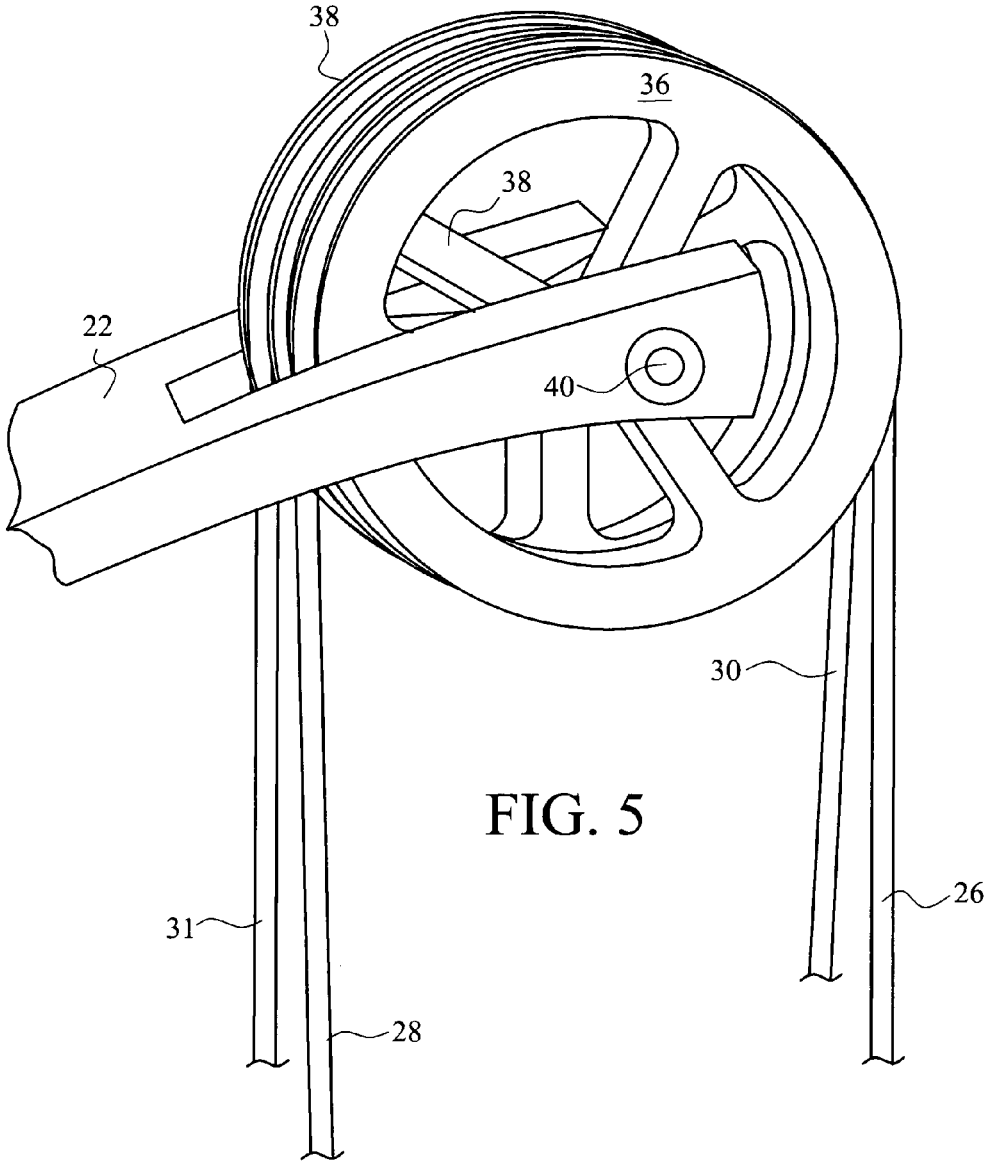
FIG. 5 is a side view in perspective of the upper limb portion of the bow of FIG. 1.

FIGS. 1–6 are illustrations of a typical embodiment of the invention. Significant elements are identified on one or more of the figures as follows:

| | | | |
|---|---|---|---|
| 20 | handle riser | 36 | first idler wheel |
| 22 | upper limb | 38 | second idler wheel |
| 24 | lower limb | 40 | upper axle |
| 25 | first cable segment | 41 | lower axle |

-continued

| | | | |
|---|---|---|---|
| 26 | bow string (central stretch) | 42 | distal limb end |
| 28 | first cable stretch | 44 | proximal limb end |
| 29 | second cable segment | 46 | yoke |
| 30 | second cable stretch | 48 | cable glide |
| 31 | third cable stretch | 50 | string anchor post(s) |
| 32 | cable guard | 52 | first cable anchor post |
| 34 | single cam element | 53 | second cable anchor post |

A bowstring element, which can include one or more segments, is entrained about rotating components of a bow to harness energy from the flexed bow limbs. As illustrated, a first cable segment 25 includes the central stretch 26 (the bowstring portion) of the rigging. Segment 25 is anchored at one end to a post 50 fixed to the single-cam element 34. A plurality of anchor posts 50 may be provided to permit adjusting a draw length of the bow. Segment 25 then extends across the limbs to wrap around the first idler wheel 36 forming a first cable stretch 28, which wraps around a first idler wheel 36. The opposite end of the segment 25 anchors to a first cable anchor post 52 carried by the single-cam element 34. A second cable segment 29 extends from the yoke 46, which is attached to opposite sides of the lower axle 41, extending therefrom as a second cable stretch 30, wrapping around the second idler wheel 38, forming a third cable stretch 31, which is anchored to a second cable anchor post 53, also carried by the single cam element 34.

The plurality of idler wheels included in the illustrated embodiment forms a rigging arrangement that provides a mechanical advantage improvement over existing single-cam compound bows. The bow shown in FIG. 1 provides four tension members arranged to flex the bow's limbs, namely stretches 26, 28, 30 and 31. In contrast, bowstring rigging generally found in commercially available single-cam bows provides only three tension members. The illustrated rigging arrangement preserves the timing advantage inherent in a single-cam element, while providing additional degrees of freedom for a bow designer better to extract energy from a bow's limbs and optimize the draw-force curve.

In an alternative construction within contemplation, the cable and bowstring rigging could be arranged as a single segment anchored at one end to the single-cam element 34. Such a unitary cable segment would then wrap a portion of the single-cam element 34, be entrained around the first idler wheel, then around a second portion of the single-cam element 34, then around the second idler wheel, and finally, be anchored at its opposite end to axle 41.

However, one benefit to providing a pair of cable segments 25, 29 is that initial rigging is greatly simplified. Also, in the event of failure of one cable segment, the other segment can operate to resist complete release of rigging-induced deflection in the bow limbs. Replacement of the failed segment is thereby made somewhat more simple. Furthermore, individual cable segments may be differently structured, e.g. optimized to carry their respective loads or to provide particular performance characteristics. Each of first and second separate segments can be made substantially from a single material, which can be different for each segment. For example, one segment can substantially be made from steel cable, and the other can substantially be made from natural or synthetic fibers optimized for use in a bow string stretch 26. Of course, it is recognized that the material of construction of portions along the length of a cable segment also can change, as is known in the art of rigging cable construction for compound archery bows.

In the illustrated embodiment of FIGS. 1–5, drawing the string 26 will cause both idler wheels 36, 38 to rotate (or pivot) in the same direction (their respective tops turning towards the archer). Because the idler wheels 36 and 38 are separately mounted for rotation about axle 40, both their rates of, and directions of, rotation are independent. Reversing the direction of wrap of either of the segments 25, 29 around the idler wheels 36, 38, respectively, will reverse the direction of that wheel during string draw. In practice, it usually is preferred for the string segment 26 to contact the surface of the idler wheel 36 closest to the archer.

Figure 6:
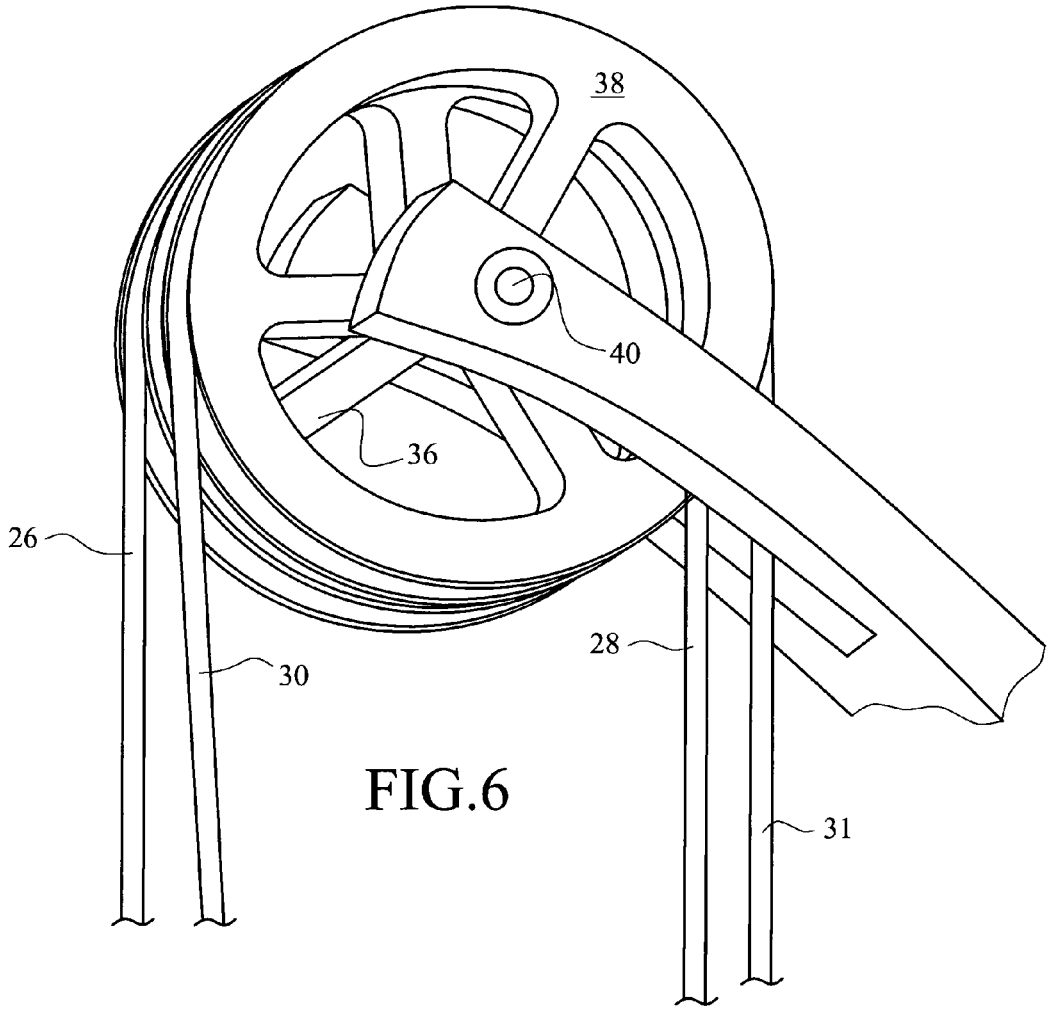
FIG. 6 is a view similar to FIG. 5 showing the opposite side of the upper limb portion with a bow string rigging arranged for opposite-direction pulley rotation.

Accordingly, in embodiments rigged to provide opposite rotational displacements of the wheels 36, 38, it is preferable for the cable segment 29 to be wrapped opposite from the configuration illustrated in FIGS. 1–5. That is, the stretch 31 may be routed to contact the wheel 38 at the surface closest to the archer, approximately adjacent the point of contact of the string 26 with the idler wheel 36. Such a rigging configuration is illustrated in FIG. 6. The cable stretch 30 then extends from the opposite side of the wheel 38 (e.g. compared to FIG. 5), so that when the bow string 26 is pulled, the wheels 36, 38 are caused to rotate in opposite directions. Of course, it is to be understood that the profile of the cam portion upon which individual cable stretch ends are wrapped may effect the rate and direction of an individual idler pulley's rotation.

While the invention has been described in particular with reference to certain illustrated embodiments, such is not intended to limit the scope of the invention. The present invention may be embodied in other specific forms without departing from its spirit or essential characteristics. The scope of the invention is, therefore, indicated by the appended claims. All changes which come within the meaning and range of equivalency of the claims are to be embraced within their scope.

What is claimed is:

1. An archery bow, comprising:

a handle with first and second ends;

a first limb with a proximal end connected to said first end of said handle and a distal end carrying an eccentric cam element;

a second limb with a proximal end connected to said second end of said handle and a distal end carrying multiple idler wheels, mounted to permit independent pivoting of each said wheel;

a bowstring element operably associated with said cam element and wheels such that when said string is pulled to pivot said cam element, said wheels are caused to pivot at different rates of angular displacement.

2. An archery bow according to claim 1, wherein said bowstring element is constructed and arranged such that said wheels are caused to rotate in different directions when said bowstring element is pulled.

3. An archery bow according to claim 2, wherein the distal end of said second limb carries a pair of idler wheels, including a first idler wheel and a second idler wheel.

4. An archery bow according to claim 3, wherein said first and second idler wheels are of substantially similar configuration.

5. An archery bow according to claim 3, wherein said first and second idler wheels carry guide tracks of substantially similar configuration.

6. An archery bow, comprising:

a handle with first and second ends;

a first limb with a proximal end connected to said first end of said handle and a distal end;

a second limb with a proximal end connected to said second end of said handle and a distal end;

a cam element operably associated with one of said limbs;

a pair of idler wheels, including a first idler wheel and a second idler wheel, operably associated with the other of said limbs; and a bowstring element operably associated with said cam element and wheels such that when a portion of said bowstring element is pulled to pivot said cam element, said wheels are caused to pivot at different rates of angular displacement, wherein a portion of said bowstring element is anchored to structure carried by said cam element.

7. An archery bow according to claim 6, wherein said first and second idler wheels are of substantially similar configuration.

8. An archery bow according to claim 6, wherein said first and second idler wheels carry guide tracks of substantially similar configuration.

9. An archery bow according to claim 6, wherein said bowstring element is constructed and arranged such that said wheels are caused to rotate in different directions when said bowstring element is pulled.

10. An archery bow according to claim 9, wherein said first and second idler wheels are of substantially similar configuration.

11. An archery bow according to claim 9, wherein said first and second idler wheels carry guide tracks of substantially similar configuration.

12. An archery bow according to claim 6, wherein said first limb is the lower limb of said bow; said second limb is the upper limb of said bow; said cam element is mounted to said lower limb and said wheels are mounted to said upper limb.

13. An archery bow according to claim 12, wherein said first and second idler wheels are of substantially similar configuration.

14. An archery bow according to claim 12, wherein said first and second idler wheels carry guide tracks of substantially similar configuration.

15. An archery bow according to claim 12, wherein said bowstring element is constructed and arranged such that said wheels are caused to rotate in different directions when said bowstring element is pulled.

16. An archery bow according to claim 15, wherein said first and second idler wheels are of substantially similar configuration.

17. An archery bow according to claim 15, wherein said first and second idler wheels carry guide tracks of substantially similar configuration.

18. An archery bow according to claim 15, wherein said cam element is mounted to the distal end of said lower limb and said idler wheels are mounted to the distal end of said upper limb.

19. An archery bow according to claim 18, wherein said first and second idler wheels are of substantially similar configuration.

20. An archery bow according to claim 18, wherein said first and second idler wheels carry guide tracks of substantially similar configuration.

21. An archery bow according to claim 18, wherein said bowstring element is constructed and arranged such that said wheels are caused to rotate in different directions when said bowstring element is pulled.

22. An archery bow according to claim 21, wherein said first and second idler wheels are of substantially similar configuration.

23. An archery bow according to claim 21, wherein said first and second idler wheels carry guide tracks of substantially similar configuration.

24. An archery bow according to claim 6, wherein when said string is pulled to pivot said cam element, said wheels are caused to pivot in the same direction.

25. An archery bow according to claim 6, wherein said wheels are concentrically mounted for pivotal motion about a common axle.

26. An archery bow according to claim 6, wherein said cam element is a single-cam structure comprising a plurality of working surfaces that are configured and arranged operably to wind and unwind respective cooperating portions of said bowstring element as said cam element pivots, and wherein said working surfaces are caused to pivot at the same rate of angular rotation.

* * * * *